US007942416B2

(12) United States Patent
Muratani et al.

(10) Patent No.: US 7,942,416 B2
(45) Date of Patent: May 17, 2011

(54) IMAGE FORMING APPARATUS, SHEET CONVEYING METHOD, AND PROGRAM FOR SHEET CONVEYANCE

(75) Inventors: Masataka Muratani, Akishima (JP); Kazumasa Yasui, Arakawa-ku (JP); Masaya Arakawa, Hiratuka (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 70 days.

(21) Appl. No.: 12/399,235

(22) Filed: Mar. 6, 2009

(65) Prior Publication Data

US 2009/0224458 A1 Sep. 10, 2009

Related U.S. Application Data

(60) Provisional application No. 61/034,395, filed on Mar. 6, 2008.

(51) Int. Cl.
*B65H 39/10* (2006.01)

(52) U.S. Cl. ..... 271/291; 271/301; 271/186; 399/401

(58) Field of Classification Search ..... 271/184, 271/186, 301, 65, 291, 3.14, 3.15, 3.17; 399/364, 399/381, 401, 389
See application file for complete search history.

(56) References Cited

U.S. PATENT DOCUMENTS

| | | | | |
|---|---|---|---|---|
| 6,128,463 | A * | 10/2000 | Matsumoto et al. | 399/364 |
| 6,328,303 | B1 * | 12/2001 | Maetani | 271/273 |
| 6,340,157 | B1 * | 1/2002 | Watanabe et al. | 271/301 |
| 6,648,320 | B2 * | 11/2003 | Iino et al. | 271/3.15 |
| 6,954,602 | B2 * | 10/2005 | Kimizuka | 399/92 |
| 6,983,122 | B2 * | 1/2006 | Hayamizu et al. | 399/405 |
| 7,339,654 | B2 * | 3/2008 | Mizubata et al. | 355/407 |
| 7,379,678 | B2 * | 5/2008 | Motoyama et al. | 399/16 |
| 7,607,658 | B2 * | 10/2009 | Fujiwara | 271/186 |
| 7,748,711 | B2 * | 7/2010 | Kawashima | 271/291 |
| 2003/0209852 | A1 * | 11/2003 | Choi | 271/291 |
| 2003/0219293 | A1 * | 11/2003 | Fujita et al. | 399/381 |
| 2008/0279601 | A1 * | 11/2008 | Sahara et al. | 399/401 |
| 2009/0067908 | A1 * | 3/2009 | Muratani et al. | 399/401 |
| 2009/0148210 | A1 * | 6/2009 | Takenaka | 399/381 |
| 2009/0162122 | A1 * | 6/2009 | Roppongi et al. | 399/401 |
| 2010/0061743 | A1 * | 3/2010 | Uematsu | 399/38 |

FOREIGN PATENT DOCUMENTS

| | | |
|---|---|---|
| JP | PH05-197240 | 8/1993 |
| JP | 0PH08-108978 | 4/1996 |
| JP | PH10-388404 | 12/1998 |

* cited by examiner

*Primary Examiner* — Kaitlin S Joerger
(74) *Attorney, Agent, or Firm* — Patterson & Sheridan, LLP

(57) ABSTRACT

A technique in an image forming apparatus in which the front and back sides of a sheet are reversed by using a reversal conveyance path is provided for causing the sheet to wait such that the sheet is not damaged when a unit for conveying the sheet to the reversal conveyance path is pulled out for the purpose of clearing a jam or the like.

A roller for conveying the sheet is controlled such that the sheet to be turned back and directed into the reversal conveyance path is caused to wait until the sheet can be conveyed into the reversal conveyance path. As a standby position of the sheet while the sheet is caused to wait, a position is set such that an upstream end portion in the second conveying direction of the sheet to be directed into the reversal conveyance path does not extend for a predetermined length or longer into another conveyance unit adjacent to the intermediate conveyance unit upstream from the intermediate conveyance unit in the second conveying direction.

10 Claims, 4 Drawing Sheets

IMAGE FORMING APPARATUS, SHEET CONVEYING METHOD, AND PROGRAM FOR SHEET CONVEYANCE

CROSS-REFERENCE TO RELATED APPLICATION

This application is based upon and claims the benefit of priority from: U.S. provisional application 61/034,395, filed on Mar. 6, 2008, the entire contents of each of which is incorporated herein by reference.

TECHNICAL FIELD

The present invention generally relates to a sheet conveying technique in an image forming apparatus, and more particularly, to processing of causing a sheet to wait at a predetermined standby position in a conveyance path on which the sheet is conveyed for reversing the front and back sides of the sheet.

BACKGROUND

Image forming apparatuses conventionally have allowed double-sided printing in which images are formed on both sides of a sheet. The double-side printing is performed, for example, by forming an image on a first surface of a sheet, turning back the sheet to change the conveying direction thereof in a relay reversal unit placed between a fuser and a discharge port, and then conveying the sheet to a reversal conveyance path to reverse the front and back sides of the sheet to form an image on a second surface thereof.

If the double-sided printing as described above is used to perform double-sided printing operation successively on a plurality of sheets, so-called alternate circulation processing is performed to achieve the double-sided printing. The alternate circulation processing is a processing method for performing the double-sided printing efficiently on a plurality of sheets by forming an image on a first surface of a sheet and then forming an image on another sheet during the reversal of the front and back sides of the former sheet. In the double-sided printing with the alternate circulation processing, however, a sheet present in a reversal conveyance path may prevent the sheet having the image formed on the first surface from being introduced into the reversal conveyance path. In this case, standby processing is performed in which the sheet is caused to wait at a predetermined standby position until it can be introduced into the reversal conveyance path since the sheet in the reversal conveyance path is moved out.

In the standby processing of the sheet, the position of upstream end of the sheet in a conveying direction toward the reversal conveyance path depends on the length of the sheet. For example, a long sheet has an upstream end portion which may protrude from a relay reversal unit and extend into another unit adjacent to the relay reversal unit during the standby state. If sheet obstruction (hereinafter referred to as a jam) occurs in the state as described above in which the sheet spans the relay reversal unit and the unit adjacent to the relay reversal unit, the relay reversal unit must be pulled out of the body of the image forming apparatus to remove the sheet. At this time, the portion of the sheet that extends into the other unit may be snagged on the unit to result in damage to the sheet.

SUMMARY

It is an object of the present invention to provide a technique, in an image forming apparatus in which the front and back sides of a sheet are reversed by using a reversal conveyance path, for preventing damage to the sheet when a unit for conveying the sheet to the reversal conveyance path is pulled out for the purpose of clearing a jam or the like.

To solve the abovementioned problem, according to an aspect, the present invention provides an image forming apparatus which turns back a sheet from a first conveying direction toward the outside of the apparatus to a second conveying direction toward the inside of a reversal conveyance path to reverse a front side and a back side of the sheet, the apparatus including an intermediate conveyance unit which is placed upstream from the reversal conveyance path in the second conveying direction and midway in a sheet conveyance path on which the sheet is conveyed during the conveyance involving the turning back, the intermediate conveyance unit being pulled out of the apparatus together with a portion of the sheet conveyance path, a roller which conveys the sheet within the sheet conveyance path in the second conveying direction, and a conveyance control section which controls the roller such that the sheet to be turned back and directed into the reversal conveyance path is caused to wait until the sheet can be conveyed into the reversal conveyance path, the conveyance control section setting, as a standby position of the sheet while the sheet is caused to wait, a position such that an upstream end portion in the second conveying direction of the sheet to be directed into the reversal conveyance path does not extend for a predetermined length or longer into another conveyance unit adjacent to the intermediate conveyance unit upstream from the intermediate conveyance unit in the second conveying direction.

According to another aspect, the present invention provides a sheet conveying method in an image forming apparatus which turns back a sheet from a first conveying direction toward the outside of the apparatus to a second conveying direction toward the inside of a reversal conveyance path to reverse a front side and a back side of the sheet, the apparatus including an intermediate conveyance unit and a roller, the intermediate conveyance unit being placed upstream from the reversal conveyance path in the second conveying direction and midway in a sheet conveyance path on which the sheet is conveyed during the conveyance involving the turning back, the intermediate conveyance unit being pulled out of the apparatus together with a portion of the sheet conveyance path, and the roller conveying the sheet within the sheet conveyance path in the second conveying direction, the method including controlling the roller such that the sheet to be turned back and directed into the reversal conveyance path is caused to wait until the sheet can be conveyed into the reversal conveyance path, and setting, as a standby position of the sheet while the sheet is caused to wait, a position such that an upstream end portion in the second conveying direction of the sheet to be directed into the reversal conveyance path does not extend for a predetermined length or longer into another conveyance unit adjacent to the intermediate conveyance unit upstream from the intermediate conveyance unit in the second conveying direction.

According to another aspect, the present invention provides a sheet conveying program for sheet conveyance in an image forming apparatus which turns back a sheet from a first conveying direction toward the outside of the apparatus to a second conveying direction toward the inside of a reversal conveyance path to reverse a front side and a back side of the sheet, the apparatus including an intermediate conveyance unit and a roller, the intermediate conveyance unit being placed upstream from the reversal conveyance path in the second conveying direction and midway in a sheet conveyance path on which the sheet is conveyed during the conveyance involving the turning back, the intermediate conveyance unit being pulled out of the apparatus together with a portion of the sheet conveyance path, and the roller conveying the sheet within the sheet conveyance path in the second conveying direction, the program including instructions which, when executed by a computer, cause the computer to perform a sheet conveying method including controlling the roller such that the sheet to be turned back and directed into the reversal conveyance path is caused to wait until the sheet can be conveyed into the reversal conveyance path and setting, as a standby position of the sheet while the sheet is caused to wait, a position such that an upstream end portion in the second conveying direction of the sheet to be directed into the reversal conveyance path does not extend for a predetermined length or longer into another conveyance unit adjacent to the intermediate conveyance unit upstream from the intermediate conveyance unit in the second conveying direction.

DETAILED DESCRIPTION

Preferred embodiments of the present invention will hereinafter be described with reference the accompanying drawings.

Figure 1:
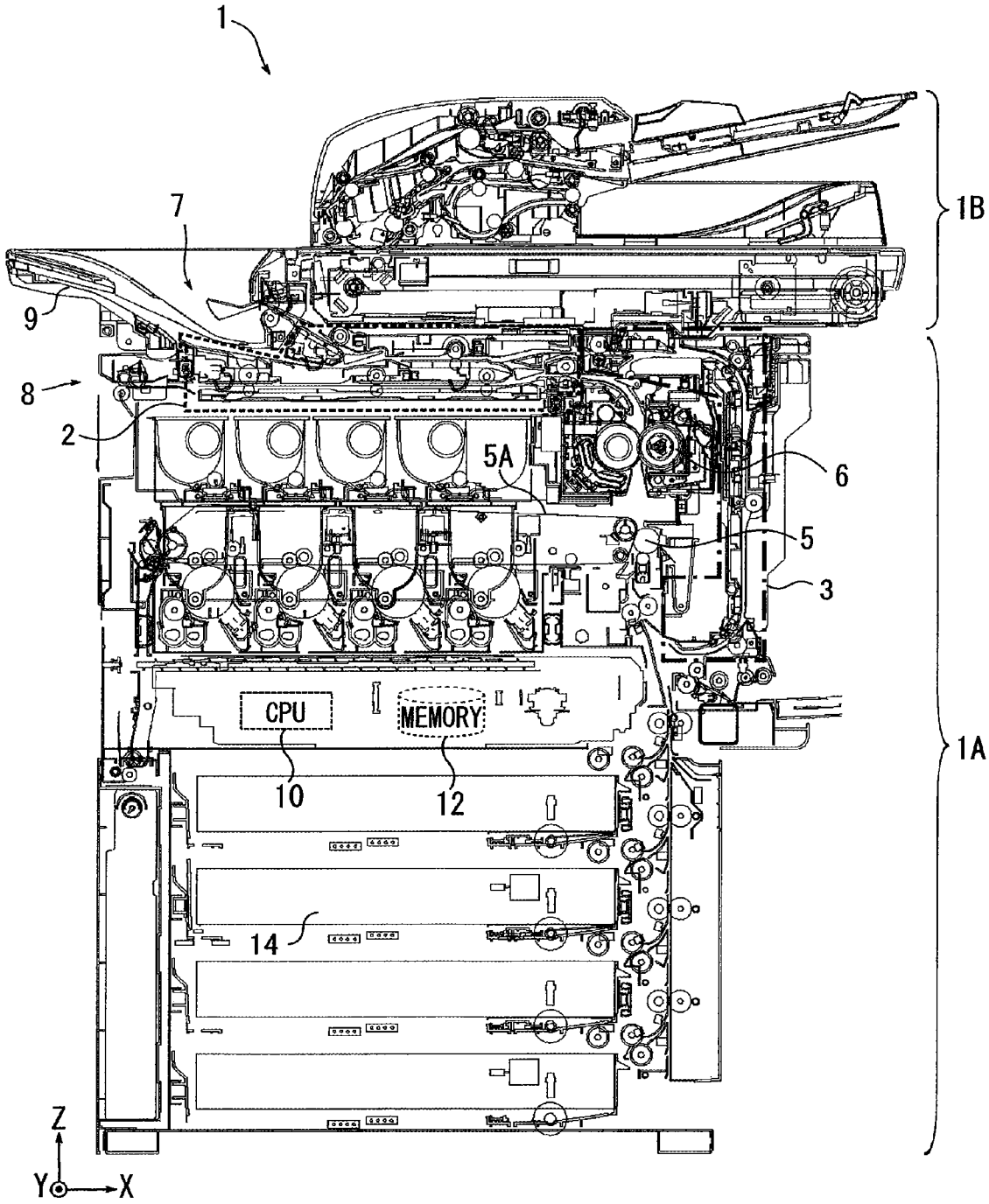
FIG. 1 is a section view showing an image forming apparatus according to Embodiment 1 of the present invention.

FIG. 1 is a section view showing an image forming apparatus 1 according to Embodiment 1.

The image forming apparatus 1 shown in FIG. 1 includes an image forming unit 1A and an image readout unit 1B. The image forming unit 1A performs processing of forming an image on a sheet such as paper and an OHP sheet. The image readout unit 1B performs processing of reading out an image on an original for copy or scanning.

The image forming unit 1A includes a relay reversal unit 2 (intermediate conveyance unit) surrounded by a dotted line in FIG. 1, a reversal conveyance path 3 surrounded by a dashed line, a transfer roller 5 and an intermediate transfer belt 5A, a fuser 6, a first discharge port 7, a second discharge port 8, a reversal retraction unit 9, a CPU 10, a memory 12, a sheet feed unit 14 and the like. In this apparatus, various programs stored in the memory 12 are executed by the CPU 10 to accomplish functions necessary for a conveyance control section and a sheet length determining section.

For forming an image on a sheet in the image forming unit 1A, the sheet is first fed by the sheet feed unit 14, and a developer image formed on the intermediate transfer belt 5A is transferred to the sheet by the transfer roller 5 (secondary transfer). The sheet having the developer image transferred thereto is supplied to the fuser 6 which heats and fixes the developer image. The sheet having the image formed thereon is conveyed and ejected through the first discharge port 7 or the second discharge port 8 via the relay reversal unit 2.

On the other hand, for performing so-called double-sided printing in which images are formed on both sides of a sheet, an image is first formed on a first surface of the sheet, then front-back reversal processing is performed in which the side of the sheet opposite to the intermediate transfer belt 5A is chanted to the other side, and then an image is formed on a second surface of the sheet. Specifically, the front-back reversal processing is performed such that the sheet having the developer image heated and fixed thereto by the fuser 6 is turned back to change the conveying direction of the sheet through the use of a conveyance path for reversal retraction in the relay reversal unit 2 and the reversal retraction unit 9 and then the sheet is conveyed to the reversal conveyance path 3. In the conveyance to the path 3, the end of the sheet located at the rear during the formation of the image on the first surface is placed at the front.

In the front-back reversal processing, if the CPU 10 of the image forming apparatus 1 determines, based on the result of detection by a sensor provided for the reversal conveyance path 3 and described later, that the sheet cannot be conveyed to the reversal conveyance path 3 due to the presence of another sheet in the reversal conveyance path 3, then the CPU 10 performs processing of causing the sheet to wait at a predetermined standby position until the sheet can be conveyed. When the sheet can be conveyed to the reversal conveyance path 3, the CPU 10 conveys the sheet to the reversal conveyance path 3, reverses the front and back sides of the sheet, and forms an image on a second surface with the intermediate transfer belt 5A and the fuser 6.

The image forming apparatus 1 of Embodiment 1 is characterized in that, in the standby processing of the sheet, the predetermined standby position is set such that the end portion of the sheet does not extend into the reversal retraction unit 9 as another unit adjacent to the relay reversal unit 2 for a predetermined length which satisfies the following condition or longer. The waiting of the sheet at such a predetermined standby position can prevent damage to the sheet when the relay reversal unit 2 is pulled out of the image forming apparatus 1 for the purpose of clearing a jam of the sheet or the like.

The processing of causing the sheet to wait at the predetermined standby position in order to prevent damage to the portion of the sheet that extends into the reversal retraction unit 9 is required if the end portion of the sheet protrudes from the relay reversal unit 2 and extends into the reversal retraction unit 9 for the predetermined length or longer during the turning back. Thus, the following description will focus on the front-back reversal of the sheet having such a length that one end portion of the sheet protrudes from the relay reversal unit 2 in the front-back reversal and that the turning back cannot be performed unless the sheet extends into the reversal retraction unit 9 for the predetermined length or longer.

Detailed description will hereinafter be made of respective components involved in the front-back reversal processing of the sheet in the image forming apparatus 1 of Embodiment 1 with reference to FIG. 2.

Figure 2:
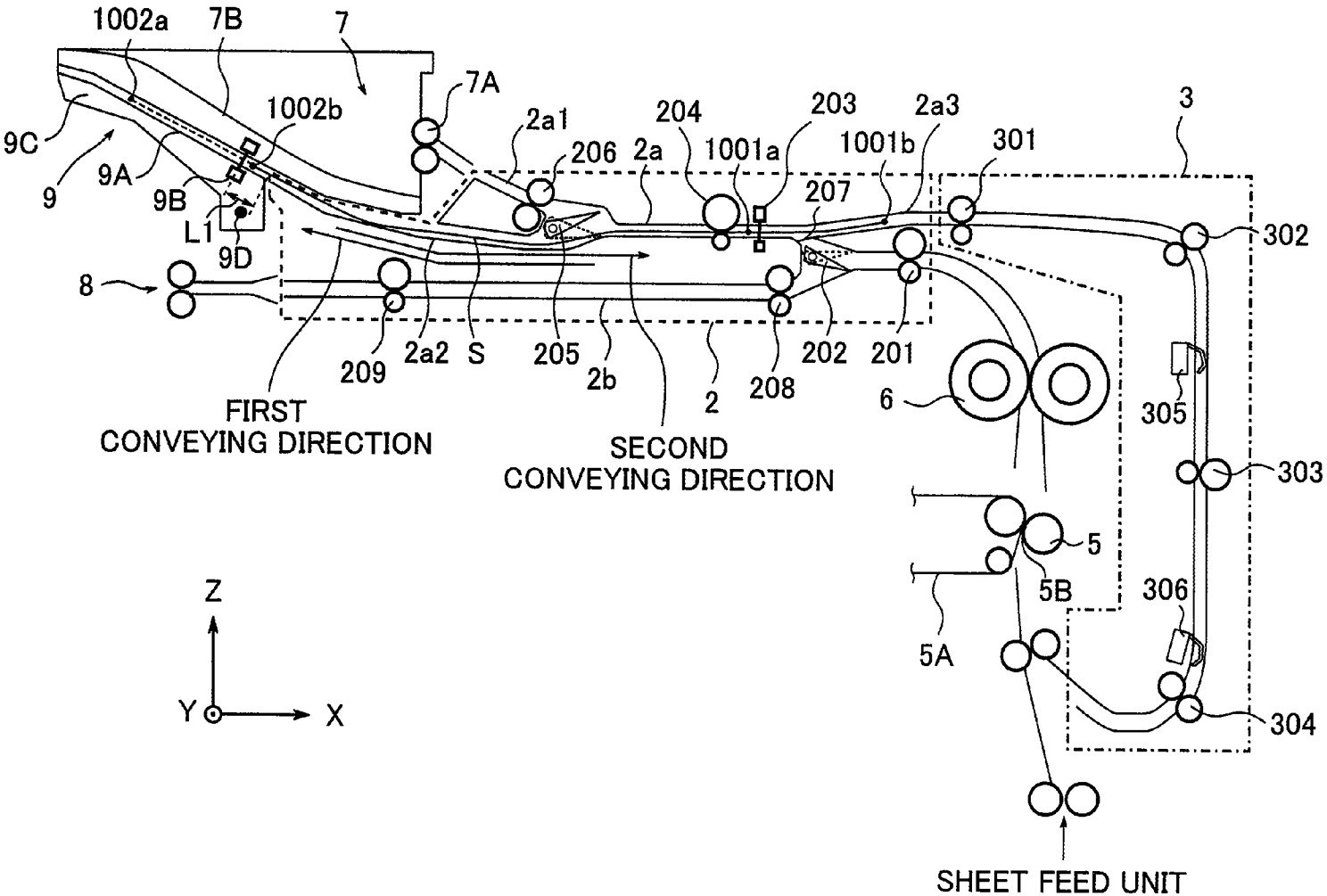
FIG. 2 is an enlarged view showing portions relating to front-back reversal processing in the image forming apparatus according to Embodiment 1.

FIG. 2 is an enlarged view showing the relay reversal unit 2, the reversal conveyance path 3, and their surroundings relating to the front-back reversal processing of the sheet in the image forming apparatus 1 of Embodiment 1. The relay reversal unit 2 is a portion indicated by a dotted line in FIG. 2. The reversal conveyance path 3 is a portion indicated by a dashed line in FIG. 2.

The relay reversal unit 2 is a conveyance unit for conveying the sheet having the image formed thereon toward the first discharge port 7 or the second discharge port 8 (in a first conveying direction shown in FIG. 2) and for turning back the sheet to change the conveying direction thereof from the first conveying direction to a second conveying direction (toward the reversal conveyance path 3 shown in FIG. 2) to convey the sheet to the reversal conveyance path 3 in performing double-sided printing. The relay reversal unit 2 is placed between the reversal conveyance path 3 and the reversal retraction unit 9 and is installed such that the unit 2 can be pulled out of the image forming apparatus 1 in a Y-axis direction in FIG. 2 along a slide rail. Thus, the relay reversal unit 2 can be pulled out to remove the sheet if a jam of the sheet or the like occurs.

The relay reversal unit 2 includes a first conveyance path 2*a* and a second conveyance path 2*b*. The first conveyance path 2*a* includes a discharge conveyance path 2*a*1 which directs the sheet to the first discharge port 7 and a retraction path 2*a*2 on which the sheet is conveyed in the turning back of the sheet.

For ejecting the sheet through the first discharge port 7, the sheet is conveyed on the discharge conveyance path 2*a*1. For conveying the sheet to the reversal conveyance path 3 to perform the front-back reversal of the sheet, the sheet is first conveyed on the retraction path 2*a*2. For conveying the sheet to the reversal conveyance path 3 after the turning back of the sheet, the sheet is conveyed to the reversal conveyance path 3 via a reversal path 2*a*3.

The second conveyance path 2*b* is provided to convey the sheet to the second discharge port 8 for ejecting the sheet through the second discharge port 8.

Conveyance roller pairs 201, 204, 206, 208, and 209 for conveying the sheet are provided on the conveyance paths. A first flapper 202 is provided for switching the sheet between the first conveyance path 2*a* and the second conveyance path 2*b*. A second flapper 205 is provided for switching the sheet between the discharge conveyance path 2*a*1 and the retraction path 2*a*2. An optical reversal sensor 203 is also provided on the side of the conveyance roller pair 204 closer to the reversal conveyance path 3 to sense the end of the sheet for the turning back. The reversal sensor 203 is placed downstream in the first conveying direction of the first conveyance path 2*a* from a reversal Mylar® 207 placed above the first flapper 202. The reversal Mylar® 207 has the function of allowing the passage of the end of the sheet conveyed from the fuser 6 through the first conveyance path 2*a* but preventing the passage of the end of the sheet toward the fuser 6 from the first conveyance path 2*a*. With the reversal sensor 203 placed downstream from the reversal Mylar® 207 in the first conveying direction as described above, the sheet can be turned back downstream from the reversal Mylar® 207 in the first conveying direction and the turned-back sheet can be conveyed to the reversal path 2*a*3 reliably.

The operations of the conveyance rollers and the flappers of the relay reversal unit 2 are controlled by the CPU 10.

A discharge roller pair 7A and an output tray 7B are provided close to the first discharge port 7. After the sheet is conveyed on the discharge conveyance path 2*a*1 of the relay reversal unit 2, the sheet is ejected onto the output tray 7B by the discharge roller pair 7A.

The reversal retraction unit 9 is provided for temporarily retracting the downstream end and its neighboring portion of the sheet in the first conveying direction until the upstream end of the sheet in the first conveying direction passes the reversal sensor 203 and is turned back during the conveyance involving the turning back. In the image forming apparatus 1 of Embodiment 1, the reversal retraction unit 9 is formed integrally with the output tray 7B of the first discharge port 7 in a lower portion of the output tray 7B. The reversal retraction unit 9 includes a reversal retraction path 9A which is connected to the retraction path 2*a*2 of the relay reversal unit 2 and an optical standby-position sensor 9B which senses the passage of the upstream end of the sheet in the second conveying direction during the turning back.

The standby-position sensor 9B is placed at a position which can cause the sheet to wait at such a predetermined standby position that the upstream end portion of the sheet in the second conveying direction does not extend into the reversal retraction path 9A for the predetermined length or longer in the standby processing performed until the sheet can enter the reversal conveyance path 3 after the turning back of the sheet.

In Embodiment 1, the standby-position sensor 9B is located at the predetermined length L1 in the first conveying direction from the end of the reversal retraction path 9A closer to the relay reversal unit 2 as shown in FIG. 2. Thus, the conveyance of the sheet is stopped when the standby-position sensor 9B senses the passage of the end of the sheet after the turning back, thereby enabling the sheet to wait at such a position that the end portion of the sheet does not extend into the reversal retraction unit 9A for the predetermined length or longer.

The predetermined length refers to the smallest of possible lengths of the portion of the sheet extending into the reversal retraction path 9A that may be damaged if the relay inverse unit 2 is pulled out of the image forming apparatus 1 in the Y-axis direction in FIG. 2 if the end portion of the sheet extends into the reversal retraction unit 9A in the standby state until the sheet can be conveyed to the reversal conveyance path 3. For example, if the length of the portion of the sheet extending into the reversal retraction path 9A is equal to or larger than the predetermined length in the standby state of the sheet, pulling out the relay reversal unit 2 causes the portion of the sheet extending into the reversal retraction path 9A to be snagged on the reversal retraction path 9A to result in damage to the sheet such as a break and bending. On the other hand, if the length of the portion of the sheet extending into the reversal retraction path 9A is smaller than the predetermined length in the standby state of the sheet, pulling out the relay reversal unit 2 cause no damage to the end portion of the sheet. Exemplary situations in which the length of the portion of the sheet extending into the reversal retraction path 9A is smaller than the predetermined length include not only the situation in which the length extending into the path 9A is smaller than the predetermined length but also the situation in which the end portion of the sheet is present in the relay reversal unit 2 and does not extend into the reversal retraction path 9A at all. In Embodiment 1, the predetermined length is shown as L1 in FIG. 2 as described above.

The specific predetermined length depends on the structure of the image forming apparatus 1, but generally falls within the range from more than 0 mm to 20 mm in a typical image forming apparatus. For example, if the predetermined length L1 is 15 mm in the image forming apparatus 1 of Embodiment 1, the sheet is caused to wait at such a position that the length of the portion of the sheet extending into the reversal retraction path 9A is smaller than 15 mm to prevent damage to the sheet when the relay reversal unit 2 is pulled out.

The length of the predetermined length refers to the length from the upstream position to the downstream end position of the edge portion of the sheet in the first conveying direction that abuts on the inner wall of the reversal retraction path 9A when the relay reversal unit 2 is pulled out.

A lower conveyance guide 9C constitutes the bottom surface of the inner wall of the reversal retraction path 9A in the reversal retraction unit 9 and can be opened downward about a rotation axis 9D. The standby-position sensor 9B is preferably placed downstream from the rotation axis 9D in the first conveying direction in the reversal retraction path 9A. With the setting of the position of the standby-position sensor 9B downstream from the rotation axis 9D in the first conveying direction, the standby-position sensor 9B is brought downward integrally with the opening of the lower conveyance guide 9C for clearing a sheet jam or the like. This effectively minimizes damage to the standby-position sensor 9B when the sheet is removed.

The reversal conveyance path 3 is provided for reversing the front and back sides of the turned-back sheet. The reversal conveyance path 3 allows the sheet having the image formed on the first surface to be conveyed therein such that the downstream end in the second conveying direction is located at the leading end. This can reverse the front and back sides of the sheet to form an image on the second surface of the sheet. After the sheet is conveyed in the reversal conveyance path 3 to reverse the front and back sides of the sheet, the sheet is again conveyed to a secondary transfer position 5B to form the image on the second surface. The reversal conveyance path 3 includes conveyance roller pairs 301 to 304, a first sensor 305 of a switch type which senses the entrance of the sheet into the reversal conveyance path 3, and a second sensor 306 of a switch type which senses the conveyance of the sheet near an exit of the reversal conveyance path 3. The CPU 10 determines whether or not the sheet can enter the reversal conveyance path 3 depending on the presence or absence of the sheet sensed by the first sensor 305 and the second sensor 306. If the CPU 10 determines, based on the result of the sensing by the sensors 305 and 306, that the sheet cannot enter the reversal conveyance path 3, then the sheet is caused to wait at the standby position. On the other hand, if the CPU 10 determines that the sheet can enter the path 3, the CPU 10 performs processing of conveying the turned-back sheet or the sheet waiting at the standby position to the reversal conveyance path 3.

Exemplary situations in which the sheet cannot enter the reversal conveyance path 3 include the situation in which the sheet is already present in the reversal conveyance path 3 and the conveyance of the sheet is sensed by both of the first sensor 305 and the second sensor 306 and the situation in which the sheet is present upstream from the reversal conveyance path 3 and is sensed only by the first sensor 305.

On the other hand, exemplary situations in which the sheet can enter the reversal conveyance path 3 include the situation in which no sheet is present in the reversal conveyance path 3 and conveyance of a sheet is not sensed by any of the first sensor 305 and the second sensor 306 and the situation in which the sheet conveyed to the reversal conveyance path is already present but the sheet is short and is sensed only by the second sensor 306 and, if a next sheet is conveyed to the reversal conveyance path 3, the sheet does not interfere with the already conveyed sheet and can be held in the reversal conveyance path 3.

Next, description will be made of the flow of the operation of the front-back reversal processing involving the standby processing of the sheet performed by the image forming apparatus 1 of Embodiment 1 having the abovementioned structure.

First, as described above, the sheet is fed by the sheet feed unit 14, the developer image formed on the intermediate transfer belt 5A is transferred to the sheet, and the developer image is heated and fixed to the sheet by the fuser 6, thereby forming an image on the first surface of the sheet. The sheet having the image formed on the first surface thereof is conveyed from the fuser 6 in the first conveying direction by the conveyance roller pair 201.

For performing the double-sided printing on the sheet, the front-back reversal processing is performed in which the sheet conveyed in the first conveying direction is turned back and conveyed in the second conveying direction to the reversal conveyance path 3.

First, in the front-back reversal processing, the CPU 10 previously performs control to set the first flapper 202 downward as shown by a solid line in FIG. 2 and to set the second flapper 205 upward in order to direct the sheet to the first conveyance path 2*a* and the retraction path 2*a*. In this state, the sheet conveyed from the fuser 6 is conveyed in the first conveying direction until the upstream end of the sheet in the first conveying direction (that is, the rear end of the sheet in the first conveying direction) passes the reversal sensor 203. The downstream end of the sheet in the first conveying direction (that is, the leading end of the sheet in the first conveying direction) is conveyed to the first conveyance path 2*a* and then to the retraction path 2*a*2 by the conveyance roller pair 204 and the like. The sheet conveyed in the retraction path 2*a*2 enters the reversal retraction path 9A within the reversal retraction unit 9 as another unit adjacent to the relay reversal unit 2.

If the reversal sensor 203 senses the passage of the rear end of the sheet during the retraction of the leading end portion of the sheet through the first conveyance path 2*a*, the retraction path 2*a*2, and the reversal retraction path 9 of the reversal retraction unit 9 as described above, the CPU 10 starts the turning back of the sheet. Specifically, if the reversal sensor 203 senses the passage of the end of the sheet, the CPU 10 performs control to stop the conveyance in the first conveying direction with the conveyance roller pair 204 to convey the sheet in the second conveying direction. For a sheet S shown in FIG. 2, the leading end of the sheet S is retracted into the retraction path 2*a*2 and the reversal retraction path 9A and reaches a turning-back position 1002*a* when the rear end of the sheet is turned back at a turning-back position 1001*a* after the rear end passes the reversal sensor 203.

After the turning back, if another sheet is already present in the reversal conveyance path 3 and thus the CPU determines based on the detection by the sensors 305 and 306 in the reversal conveyance path 3 that the sheet having the image formed on the first surface cannot be conveyed to the reversal conveyance path 3, then the image forming apparatus 1 of Embodiment 1 performs processing of conveying the sheet in the second conveying direction from the turning-back position to the predetermined standby position and causing the sheet to wait at the predetermined standby position.

Specifically, for the sheet S shown in FIG. 2, the upstream end in the second conveying direction (that is, the rear end of the sheet in the second conveying direction) is placed at the turning-back position 1002*a* and the upstream end portion extends into the reversal retraction path 9A for more than the predetermined length L1 at the time of the start of the turning back. If the relay reversal unit 2 is pulled out in this state, the portion of the sheet extending into the reversal retraction path 9A is damaged. Thus, the CPU 10 drives the conveyance roller pair to convey the sheet in the second conveying direction until the length of the portion of the sheet extending into the reversal retraction path 9A becomes smaller than the predetermined length L1. The CPU 10 then causes the sheet to wait. Specifically, after the sheet S is turned back at the turning-back position 1002*a*, the sheet S is conveyed in the second conveying direction until the passage of the upstream end in the second conveying direction is sensed by the standby-position sensor 9B. When the standby-position sensor 9B senses the passage of the upstream end of the sheet S, the CPU 10 stops the driving of the conveyance roller pair 204 to cause the sheet S to wait. The end of the sheet S shown in FIG. 2 within the reversal retraction path 9A moves from the turning-back position 1002*a* to a standby position 1002*b* before the standby, while the end of the sheet S closer to the reversal conveyance path 3 moves from the turning-back position 1001*a* to a standby position 1001*b* before the standby.

With the standby processing after the turning back as described above, the image forming apparatus 1 can cause the sheet S to wait in such a state that the end portion of the sheet S does not extend into the reversal retraction path 9A of the reversal retraction unit 9 adjacent to the relay reversal unit 2 for the predetermined length L1 or longer. When a jam or the like occurs in the standby state and the relay reversal unit 2 is pulled out of the image forming apparatus 1, any damage is advantageously prevented to the portion of the sheet S within and closer to the reversal retraction unit 9. This can eliminate waste of the sheet due to damage to the sheet and prevent occurrence of problems in the image forming apparatus 1 that would be caused by any broken portion of the sheet remaining in the image forming apparatus 1.

If the turning-back position is used as the standby position, the sheet is caused to wait with one end portion thereof extending long into the reversal retraction unit 9 adjacent to the relay inverse unit 2 depending on the length of the sheet. When the relay reversal unit 2 is pulled out in this state, the sheet suffers from damage such as a break of the one end portion.

As described above, according to the image forming apparatus 1 of Embodiment 1, if the front and back sides of the long sheet are reversed for the double-sided printing or the like, damage to the sheet can be prevented in pulling out the relay reversal unit 2 to clear a jam.

Although FIG. 2 shows the turning-back position 1001*a* shifted from the reversal sensor 203 for the sake of clarity, they are not necessarily positioned with such a large shift. In reality, the conveyance in the first conveying direction is stopped and the turning back is performed immediately after the reversal sensor 203 detects the abovementioned end of the sheet, so that the positions of the reversal sensor 203 and the turning-back position 1001*a* can substantially coincide, for example. Similarly, the positions of the standby-position sensor 9B and the standby position 1002*b* are not necessarily shifted, and the standby position 1002*b* and the standby position 9B can substantially coincide.

In some cases, both of a long sheet and a short sheet are present in the image forming apparatus 1. The long sheet needs to wait at the predetermined standby position after turning back since the end portion of the sheet extends into the reversal retraction path 9A for the predetermined length or longer at the time of the turning back. The short sheet does not need to wait at the predetermined standby position 1001*b* after turning back since the end portion of the sheet does not extend into the reversal retraction path 9A for the predetermined length or longer at the time of the turning back. In this case, the image forming apparatus 1 according to Embodiment 1 can perform the predetermined standby processing described above only in the reversal of the front and back sides of the former long sheet which requires the standby processing.

If the sheet to be turned back is the long sheet as described above, the passage of the end of the sheet is sensed by the two sensors, that is, the standby-position sensor 9B and the reversal sensor 203. Specifically, for the long sheet, the standby-position sensor 9B senses the passage of the downstream end of the sheet in the first conveying direction and then the reversal sensor 203 senses the passage of the upstream end of the sheet in the first conveying direction. When the standby-position sensor 9B and the reversal sensor 203 sense the passage of the ends of the sheet in this manner, the CPU 10 controls the conveyance roller pair 204 to perform the predetermined standby processing described above. As a result, if both of the long sheet requiring the predetermined standby processing and the short sheet requiring no standby processing are present, the predetermined standby processing can be performed only on the long sheet.

Figure 3:
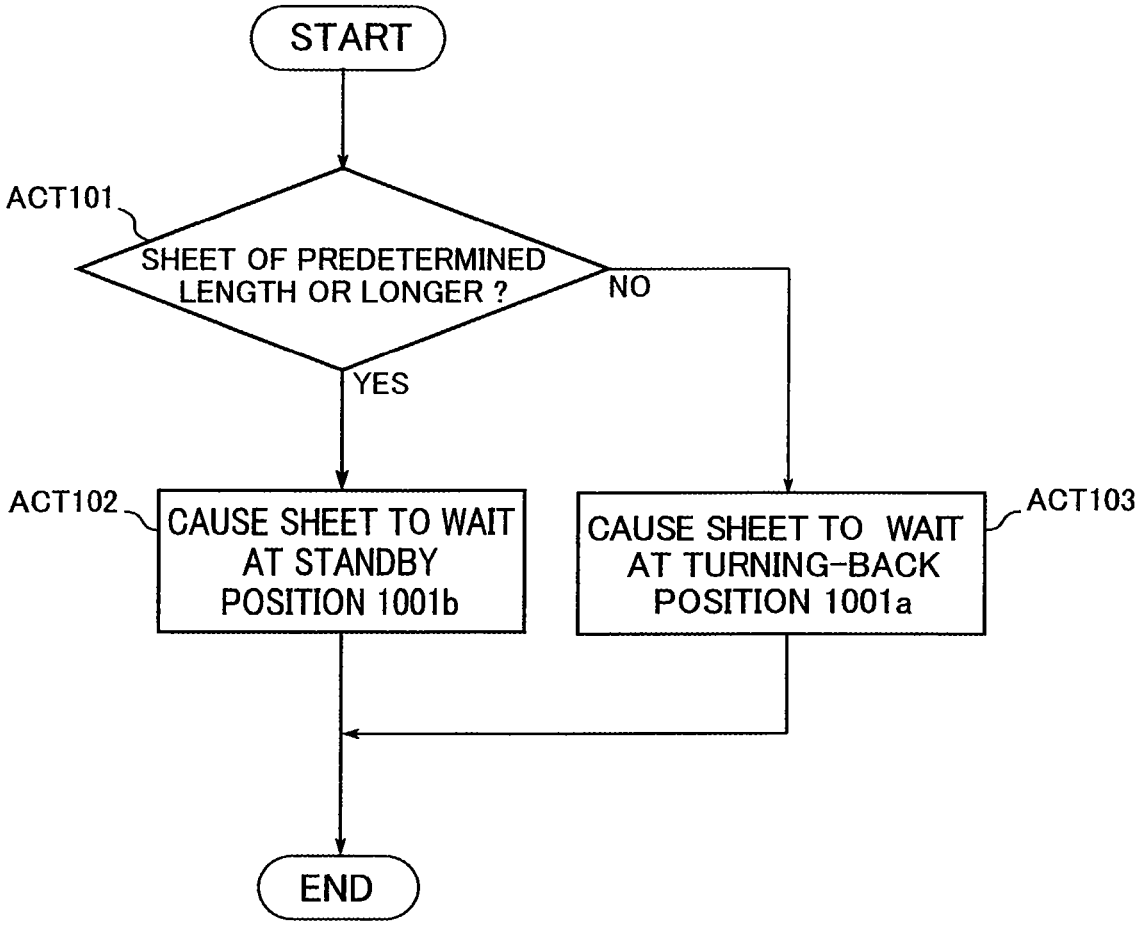
FIG. 3 is a flow chart for explaining processing of determining whether or not standby processing performed by the image forming apparatus according to Embodiment 1 is performed.

The image forming apparatus 1 can be provided with a sensor which detects the length in the conveying direction of the sheet subjected to the front-back reversal processing. The sensor can be used to perform processing of causing the sheet to wait at the predetermined standby position if the length of the sheet is equal to or larger than a predetermined length in accordance with the flow of processing shown in FIG. 3. Specifically, only if the CPU 10 determines that the length of the sheet in the conveying direction obtained from the detection by the sensor is equal to or longer than such a length that the end portion of the sheet extends into the reversal retraction path 9A for the predetermined length or longer at the time of turning back (S101, YES), then the CPU 10 causes the sheet to wait at the predetermined standby position 1001*b* (1002*b*) (S102). The length of the sheet in the conveying direction can be determined, for example, from the size of the sheet obtained by a sensor which is provided for the sheet feed unit 14 to detect the size of the sheet. Alternatively, a sensor can be additionally provided for detecting the length of the sheet in the conveying direction. If the CPU 10 determines that the length of the sheet in the conveying direction is such a length that the end portion of the sheet does not extend into the reversal retraction path 9A for the predetermined length or longer at the time of the turning back (S101, NO), the sheet can be caused to wait at the turning-back position 1001*a* (S103).

While the image forming apparatus 1 of Embodiment 1 has been described in conjunction with the reversal retraction unit 9 provided within the output tray 7B, the present invention is not limited thereto. For example, a reversal retraction unit may be provided separately from the first discharge port 7 as required, and the reversal retraction unit may be provided either below or above the first discharge port 7.

While Embodiment 1 has been illustrated with the reversal sensor 203 and the standby-position sensor 9B which are formed of the optical sensors and with the first sensor 305 and the second sensor 306 in the reversal conveyance path 3 which are formed of the switch-type sensors, the present invention is not limited thereto. As long as the passage of the sheet can be sensed, any device can be used. Alternatively, a camera for shooting the sheet being conveyed may be provided and the obtained image may be subjected to image processing, thereby sensing the passage of the sheet and the presence or absence of the sheet, by way of example.

Embodiment 2

Next, Embodiment 2 of the present invention will be described.

Embodiment 2 of the present invention is a modification of Embodiment 1 of the present invention described above. Embodiment 2 differs from Embodiment 1 in that a stepping motor is used as a unit for stopping a sheet at a predetermined standby position after turning back of the sheet. The stepping motor in Embodiment 2 serves as a unit for driving a conveyance roller pair 204 such that the sheet can be conveyed for an arbitrary distance.

Embodiment 2 of the present invention will hereinafter be described with reference to FIG. 4. It should be noted that components identical to those described in Embodiment 1 are designated with the same reference numerals and description thereof is omitted.

Figure 4:
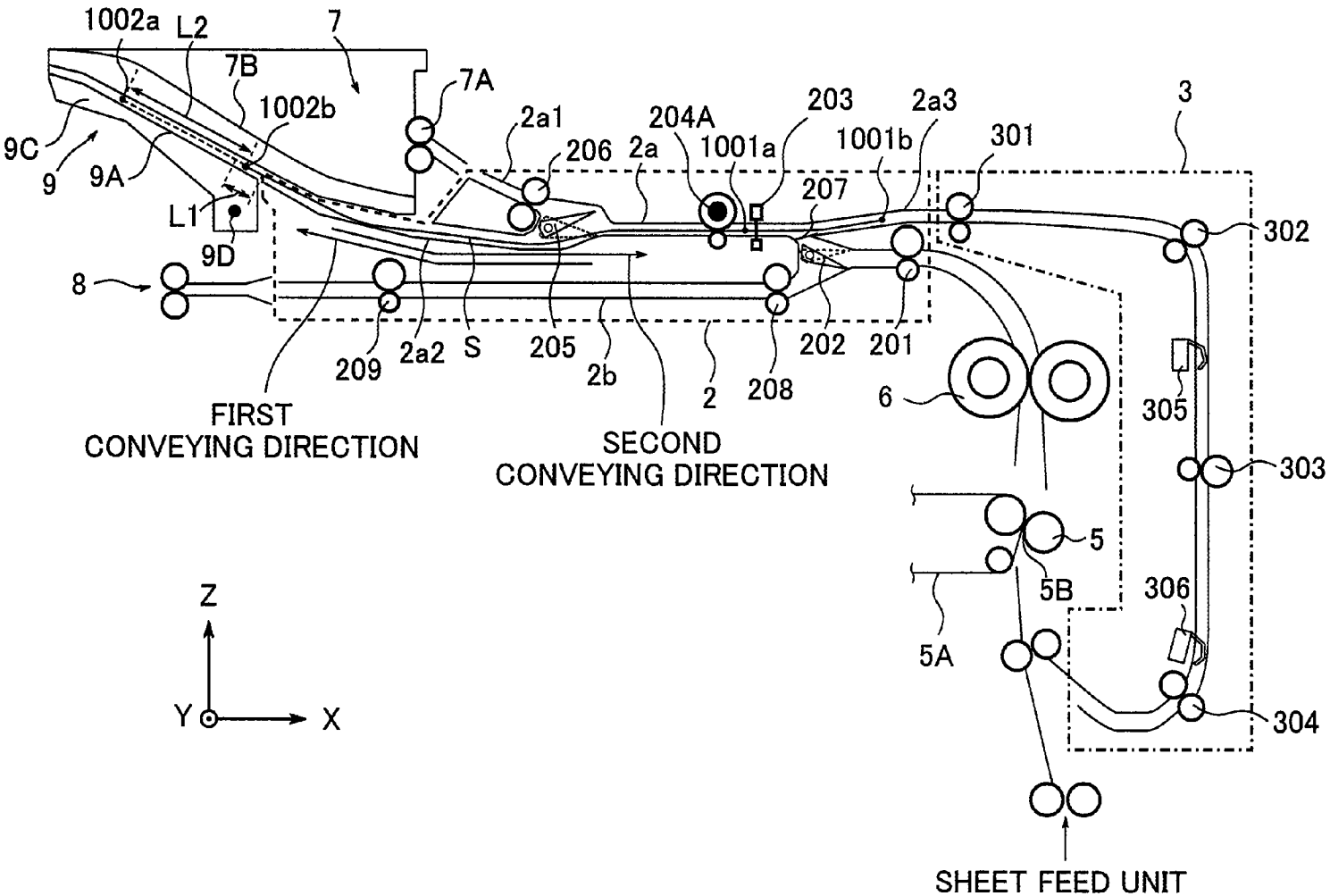
FIG. 4 is an enlarged view showing portions relating to front-back reversal processing in the image forming apparatus according to Embodiment 2.

FIG. 4 is an enlarged view showing a relay reversal unit 2, a reversal conveyance path 3, and their surroundings in an image forming apparatus 1 as shown in FIG. 2 according to Embodiment 1 described above.

The image forming apparatus 1 of Embodiment 2 includes a conveyance roller pair 204A driven by the stepping motor which can control the conveyance distance of a sheet. The conveyance distance is a length previously calculated from a turning-back position to a standby position specified such that the end portion of the sheet does not extend into a reversal retraction path 9A for a predetermined length or longer. Standby processing after turning back of the sheet is performed by conveying the sheet for the conveyance distance with the conveyance roller pair 204A. By way of example, a sheet S shown in FIG. 4 is conveyed for a conveyance distance L2 over which the end of the sheet S closer to the reversal retraction path 9A moves from a turning-back position 1002*a* to a standby position 1002*b*.

The conveyance distance L2 can be determined, for the sheet S, from the difference between the length of the sheet S in the conveying direction and the distance between a turning-back position 1001*a* and the standby position 1002*b*. The length of the sheet in the conveying direction can be previously determined by detecting the size of the sheet in a sheet feed unit 14, for example. The distance between the turning-back position 1001*a* and the standby position 1002*b* is determined as a value specific to the image forming apparatus 1 by previously setting the standby position 1002*b* at an arbitrary position which falls within a predetermined length L1 representing the length of the end portion of the sheet extending into the reversal retraction path 9A. Thus, the distance between the positions 1001*a* and 1002*b* is previously stored in a memory 12, and the length of the sheet in the conveying direction is detected in conveying the sheet S, so that the conveyance distance L2 of the sheet S can be determined by the CPU 10 from those values.

Next, description will be made of the flow of processing of causing the sheet S to wait at the predetermined standby position in Embodiment 2.

First, the CPU 10 drives the conveyance roller pair to convey the sheet S in the first conveying direction within the first conveyance path 2*a* until the passage of the rear end of the sheet S in the first conveying direction is sensed by a reversal sensor 203. When the reversal sensor 203 senses the passage of the rear end in the first conveying direction, the CPU 10 stops the driving of the conveyance roller pair 204A in the first conveying direction. Then, the CPU 10 drives the stepping motor for the conveyance roller pair 204A such that the sheet S is conveyed in the second conveying direction for the conveyance distance L determined previously on the basis of the length of the sheet S and the distance between the points 1001*a* and 1002*b*.

Through the flow of the processing, the CPU 10 can cause the sheet S to wait at such a predetermined standby position that the upstream end portion of the sheet in the second conveying direction does not extend into the reversal conveyance path 9A for the predetermined length or longer after the turning back of the sheet S.

Then, if the CPU 10 determines that the sheet S can be conveyed to the reversal conveyance path 3 based on the sensing by sensors 305 and 306 similarly to Embodiment 1, the sheet S is conveyed to the reversal conveyance path 3 to perform front-back reversal of the sheet S. After the front-back reversal of the sheet S, the sheet is again conveyed to a secondary transfer position 5B and a fuser 6 to allow formation of an image on a second surface of the sheet.

As described above, the sheet can be caused to wait at the predetermined standby position in the front-back reversal processing of the sheet in Embodiment 2, as in Embodiment 1. If the relay reversal unit 2 is pulled out of the image forming apparatus 1 due to a jam during the standby of the sheet until it can be conveyed to the reversal conveyance path 3, no damage is caused to a portion of the sheet close to the reversal retraction path 9A.

The program for performing the abovementioned acts in a computer constituting the image forming apparatus can be provided as a sheet conveying program. While Embodiments 1 and 2 illustrate an example in which the program for realizing the functions implementing the present invention is previously recorded on a storage area provided in the apparatus, the present invention is not limited thereto. Such a program may be downloaded from a network to the apparatus, or such a program stored on a computer-readable recording medium may be installed on the apparatus. The recording medium may take any form as long as it can store a program and be read by a computer. Specifically, examples of the recording medium include internal storage implemented in a computer such as a ROM and a RAM, a portable storage medium such as a CD-ROM, a flexible disk, a DVD disk, a magneto-optical disk, and an IC card, a database for holding a computer program, another computer and its database, a transmission medium over a channel, and the like. The functions provided from the previous installation or download may be realized by cooperation with an OS (operating system) in the apparatus or the like.

The program in Embodiments 1 and 2 includes a program in which an executable module is dynamically produced.

While the present invention has been described in detail according to the specific aspects, it is apparent to those skilled in the art that various changes and alterations can be made without departing from the true spirit or scope of the present invention.

As described in detail, the present invention can provide the technique for preventing damage to the sheet when the unit for conveying the sheet to the reversal conveyance path is pulled out for the purpose of clearing a jam or the like in the image forming apparatus in which the front-back reversal processing of the sheet is performed by using the reversal conveyance path.

What is claimed is:

1. An image forming apparatus which turns back a sheet from a first conveying direction toward the outside of the apparatus to a second conveying direction toward the inside of a reversal conveyance path to reverse a front side and a back side of the sheet, the apparatus comprising:

an intermediate conveyance unit and an outer conveyance unit, the intermediate conveyance unit being positioned upstream from the reversal conveyance path in the second conveying direction and midway in a sheet conveyance path on which the sheet is conveyed during the conveyance involving the turning back, the intermediate conveyance unit being configured to be pulled out of the apparatus together with a portion of the sheet conveyance path, the outer conveyance unit being positioned adjacent to the intermediate conveyance unit upstream from the intermediate conveyance unit in the second conveying direction;

a roller which conveys the sheet within the sheet conveyance path in the second conveying direction;

a sheet length determining section which determines whether or not the sheet to be turned back is long enough in a sheet conveying direction so as to extend into the outer conveyance unit during the conveyance of the sheet involving the turning back; and a conveyance control section which controls the roller such that the sheet to be turned back and directed into the reversal conveyance path is caused to wait until the sheet can be conveyed into the reversal conveyance path, the conveyance control section setting, as a standby position of the sheet while the sheet is caused to wait, a position such that an upstream end portion in the second conveying direction of the sheet to be directed into the reversal conveyance path does not extend for a predetermined length or longer into the outer conveyance unit, and causing the sheet to wait at the standby position only if the sheet length determining section determines that the sheet is long enough so as to extend into the outer conveyance unit during the conveyance involving the turning back.

2. The apparatus of claim 1, further comprising an output tray in which a sheet discharged from the image forming apparatus is put, wherein the outer conveyance unit is placed below the entire output tray or below a portion of the output tray.

3. The apparatus of claim 1, wherein the predetermined length is set in a range from more than 0 mm to 20 mm.

4. The apparatus of claim 1, further comprising a sensor which is placed at a position in the outer conveyance unit and detects the passage of the sheet, the position being at the predetermined length from an upstream end of the outer conveyance unit in the first conveying direction, wherein the sheet length determining section determines based on the result of sensing by the sensor whether or not the sheet to be turned back is long enough in a sheet conveying direction so as to extend into the outer conveyance unit during the conveyance of the sheet involving the turning back.

5. The apparatus of claim 4, wherein a lower conveyance guide constituting a bottom surface of an inner wall of a conveyance path in the outer conveyance unit is openable downward about a predetermined rotation axis, and wherein the sensor is placed downstream from the rotation axis in the first conveying direction.

6. A sheet conveying method in an image forming apparatus which turns back a sheet from a first conveying direction toward the outside of the apparatus to a second conveying direction toward the inside of a reversal conveyance path to reverse a front side and a back side of the sheet, the apparatus including an intermediate conveyance unit, an outer conveyance unit, and a roller, the intermediate conveyance unit being positioned upstream from the reversal conveyance path in the second conveying direction and midway in a sheet conveyance path on which the sheet is conveyed during the conveyance involving the turning back, the outer conveyance unit being positioned adjacent to the intermediate conveyance unit upstream from the intermediate conveyance unit in the second conveying direction, the intermediate conveyance unit being configured to be pulled out of the apparatus together with a portion of the sheet conveyance path, and the roller conveying the sheet within the sheet conveyance path in the second conveying direction, the method comprising:

determining whether or not the sheet to be turned back is long enough in a sheet conveying direction so as to extend into the other conveyance unit during the conveyance of the sheet involving the turning back;

controlling a roller such that the sheet to be turned back and directed into the reversal conveyance path is caused to wait until the sheet can be conveyed into the reversal conveyance path;

setting, as a standby position of the sheet while the sheet is caused to wait, a position such that an upstream end portion in the second conveying direction of the sheet to be directed into the reversal conveyance path does not extend for a predetermined length or longer into the outer conveyance unit adjacent to the intermediate conveyance unit upstream from the intermediate conveyance unit in the second conveying direction; and causing the sheet to wait at the standby position only if it is determined that the sheet is long enough so as to extend into the outer conveyance unit during the conveyance involving the turning back.

7. The method of claim 6, wherein the image forming apparatus further includes an output tray in which a sheet discharged from the image forming apparatus is put, wherein the outer conveyance unit is placed below the entire output tray or below a portion of the output tray.

8. The method of claim 6, wherein the predetermined length is set in a range from more than 0 mm to 20 mm.

9. The method of claim 6, wherein the image forming apparatus further includes a sensor placed at a position in the outer conveyance unit and detecting the passage of the sheet, the position being at the predetermined length from an upstream end of the other conveyance unit in the first conveying direction, wherein it is determined on the basis of the result of sensing by the sensor whether or not the sheet to be turned back is long enough in a sheet conveying direction so as to extend into the outer conveyance unit during the conveyance of the sheet involving the turning back.

10. The method of claim 9, wherein a lower conveyance guide constituting a bottom surface of an inner wall of a conveyance path in the outer conveyance unit is openable downward about a predetermined rotation axis, and wherein the sensor is placed downstream from the rotation axis in the first conveying direction.

* * * * *